US005744090A

United States Patent [19]

Jones et al.

[11] Patent Number: 5,744,090

[45] Date of Patent: Apr. 28, 1998

[54] PROCESS FOR THE MANUFACTURE OF CONDUCTIVE FIBERS USABLE IN ELECTROSTATIC CLEANING DEVICES

[75] Inventors: Lewis O. Jones; Joseph A. Swift, both of Ontario; Ronald F. Ziolo, Webster, all of N.Y.

[73] Assignee: Xerox Corporation, Stamford, Conn.

[21] Appl. No.: 781,304

[22] Filed: Jan. 13, 1997

[51] Int. Cl.[6] ..... D01F 1/09

[52] U.S. Cl. ..... 264/427; 264/104; 264/105; 264/184; 264/187; 264/205; 264/210.6; 264/210.8; 264/211

[58] Field of Search ..... 264/104, 105, 264/184, 187, 205, 210.6, 210.8, 211, 427

[56] References Cited

U.S. PATENT DOCUMENTS

| | | | |
|---|---|---|---|
| 3,070,841 | 1/1963 | Schornstheimer | 264/427 |
| 4,319,831 | 3/1982 | Matsui et al. . | |
| 4,781,971 | 11/1988 | Marikar et al. . | |
| 4,835,056 | 5/1989 | Sanders et al. . | |
| 4,835,807 | 6/1989 | Swift . | |
| 5,298,028 | 3/1994 | Hsu . | |
| 5,391,432 | 2/1995 | Mitchnick et al. . | |

FOREIGN PATENT DOCUMENTS

| | | | |
|---|---|---|---|
| 51-62396 | 5/1976 | Japan | 264/427 |

*Primary Examiner*—Leo B. Tentoni
*Attorney, Agent, or Firm*—Oliff & Berridge, P.L.C.

[57] ABSTRACT

A method of making a conductive fiber in which the conductive fiber is formed from a mixture including at least one fiber forming material and conductive magnetic materials, and the conductive magnetic materials are migrated toward the periphery of the fiber by application of a magnetic field to the fiber. The conductive fibers having the conductive magnetic materials located at the periphery of the fiber are preferably incorporated into an electrostatic cleaning device for use in an electrostatographic printing device.

13 Claims, 3 Drawing Sheets

PROCESS FOR THE MANUFACTURE OF CONDUCTIVE FIBERS USABLE IN ELECTROSTATIC CLEANING DEVICES

BACKGROUND OF THE INVENTION

1. Field of Invention

The invention relates to a process for manufacturing conductive fibers, in particular fibers suitable for use in electrostatic cleaning devices for removing residual toner from the surface of an imaging member following transfer of an image to an image receiving substrate.

2. Description of Related Art

In a typical electrostatographic printing device, such as a photocopier, laser printer, facsimile machine or the like, an imaging member such as, for example, a photoreceptor drum, is employed. The imaging member continuously rotates to various stations in forming images. In a simple process in which black and white images are formed, for example, at the first station, the imaging member is exposed to an image to be printed. Exposure of the imaging member to the image to be printed records an electrostatic latent image on the imaging member corresponding to the informational areas contained within the image to be printed. The imaging member then rotates to a developing station where the electrostatic latent image is developed by bringing a toner or developer mixture into contact with the image.

After the image is developed on the imaging member, the imaging member rotates to a transfer station. Here, the developed toner image is transferred from the imaging member to either an image receiving substrate such as paper or plastic, or to an intermediate transfer member that subsequently transfers the image to an image receiving substrate.

Following transfer of the developed image, the imaging member is then ultimately rotated back to the first station to again receive an electrostatic latent image. Thus, it is necessary that any residual toner remaining on the imaging member surface following transfer of a developed image be removed from the surface of the imaging member prior to the imaging member receiving a subsequent electrostatic latent image. If the residual toner is not removed, subsequent images produced using the imaging member may be stained or fogged due to the presence of the residual toner.

Thus, following transfer of a developed image from the imaging member, the imaging member surface is typically contacted with a cleaning member such as a rotary brush containing conductive or antistatic fibers that contact the surface of the imaging member to remove and retain residual toner particles. It is necessary that the conductive fibers of the cleaning member be sufficiently soft so that the surface of the imaging member is not scratched by the fibers, and also that they be of a sufficient electrical conductivity to be able to attract and retain the residual toner particles from the surface of the imaging member. When thermoplastic or polymeric composite materials are used for the conductive fibers, the fibers typically must have a very fine diameter, for example less than 50 microns, and a high content of conductive filler material, for example, 10 to 50% by weight, in order to meet the requirements for use in a cleaning member of an electrostatographic printing device. Currently available fine diameter conductive fibers have proven marginally unacceptable in performance when used in electrostatic cleaning devices in electrostatographic printing devices.

Typically, fibers are made in continuous strands by spinning, for example wet, dry or melt spinning, a fiber forming material followed by solidifying the fiber. Typical spinning processes require that the filament under process possess and maintain a minimum tensile strength, for example on the order of 1,000 to 20,000 psi, in order to preclude breakage of the fiber during the process and during subsequent tensioning and drawing operations. As such, it is very difficult to obtain high loadings of conductive materials in the fiber forming materials because these additives act as flaw initiating sites in the fiber and result in localized low tensile strengths, and thus random fiber breakage, which unsatisfactorily interrupts continuous fiber formation. Because the spinning composition can contain only low amounts of conductive additives, it is very difficult to obtain conductive fiber by a continuous spinning process which possesses a sufficiently low fiber resistivity rendering the fiber suitable for use in an electrostatic cleaning device.

In recognition of this problem, various methods are proposed in the related art for obtaining lower resistivity spun fibers.

U.S. Pat. No. 5,391,432 to Mitchnick et al. discloses electrically conductive fibers containing from 1 to 90% by weight of rod-shaped zinc oxide conductive particles. The inclusion of the rod-shaped zinc oxide particles is disclosed to permit a larger amount of conductive particles without diminishing the conductivity of the fiber upon drawing of the fiber.

U.S. Pat. No. 5,298,028 to Hsu discloses a method for producing fibers having particulate materials embedded in a very thin layer of the surface of the fibers. The fibers are produced by spinning an aramid material into a fiber, drying the fiber, and then swelling the surface of the fiber with a liquid system containing the particulate material so as to embed the particulate material in the outer layer of the swollen fiber. The fiber is then again dried to achieve the end fiber.

U.S. Pat. No. 4,835,056 to Sanders et al. discloses a method for making a conductive fiber comprising forming a fiber from a material that has catalytic sites throughout the fiber, and then electrolessly depositing a metal upon the fiber. It is disclosed that due to the presence of the catalytic sites, the electrolessly deposited metal is located not just on the outer surface of the fiber, but also just inside the periphery of the fiber.

U.S. Pat. No. 4,781,971 to Marikar et al. discloses a method for forming electrically conductive acrylic fibers comprising spinning and thermally stabilizing the acrylic fibers, followed by ion impregnating the fibers with a source of cuprous ions in a solution. The cuprous ions are disclosed as being capable of dispersing into the fibrous material.

It is also typical to form conjugate conductive fibers for use in electrostatic cleaning devices. For example, U.S. Pat. No. 4,319,81 to Matsui et al. discloses a cleaning device for use in a copying machine. The conductive fibers of the cleaning device are conjugate fibers. Both side-by-side fibers and sheath-core fibers are disclosed. The preferred conjugate fiber is disclosed as comprising a non-conductive core fiber surrounded by a sheath containing conductive materials.

U.S. Pat. No. 4,835,807 to Swift discloses a cleaning brush containing electroconductive nylon fibers and carbon black suffused through the surface of the fibers in an amount such that the electrical resistance of the fiber is from $10^3$ to $10^9$ ohms per centimeter.

SUMMARY OF THE INVENTION

It is an object of this invention to develop a simple method for continuously forming conductive fibers having excellent electrical conductivities and mechanical strength. It is a further object of this invention to develop a method capable of forming fine diameter conductive fibers from a fiber forming composition containing conductive magnetic filler materials so that post-fiber forming processing to impart conductivity is not necessary. It is a further object of this invention to develop a method for forming conductive fibers that are readily processed and formed into a single fiber, i.e., a non-conjugate fiber.

It is yet a further object of this invention to develop a method for forming conductive fibers of fine diameter and excellent electrical conductivity suitable for use in electrostatic cleaning devices used in electrostatographic printing devices.

These and other objects are achieved in the invention by a method in which fibers are formed from a composition containing a fiber forming material and conductive magnetic materials, and applying to the formed fiber prior to final solidification a magnetic field sufficient to migrate the conductive magnetic materials toward the outer periphery of the fiber. In this manner, fine diameter conductive fibers can be formed in a continuous process without post-fiber formation processing to impart conductivity. The method also allows for the formation of higher electrical conductivity fibers containing a lower total weight percentage of conductive magnetic filler material, thereby resulting in cost savings and high strength. The method permits the formation of conductive fibers having sufficient fineness and conductivity such that when the fibers are used in an electrostatic cleaning device in an electrostatographic printing device, residual toner is completely removed from the imaging member surface over long periods of operation.

DETAILED DESCRIPTION OF PREFERRED EMBODIMENTS

Figure 1A:
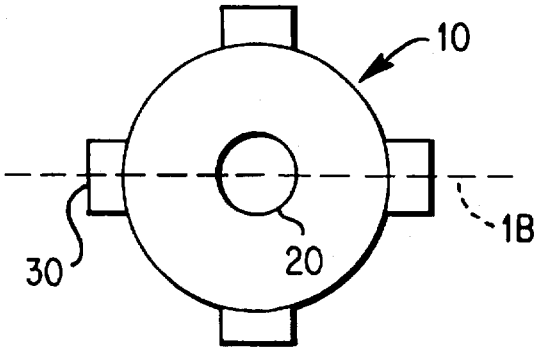
FIGS. 1A–1B are different views of a magnet that can be applied to a fiber in the invention.

In the process of the invention, a conductive fiber is obtained in a continuous manner. The fiber is preferably formed by conventional spinning techniques, including wet spinning, dry spinning and melt spinning. As is known in the art, wet spinning commonly is conducted by dissolving a fiber forming material in an appropriate solvent and passing the solution of the fiber forming material through an opening (i.e., an orifice or spinneret) of predetermined shape into an aqueous coagulation bath. Dry spinning commonly is conducted by dissolving the fiber forming material in an appropriate solvent and passing the solution of the fiber forming material through an opening of predetermined shape into an evaporative gas atmosphere such as nitrogen where most of the solvent is evaporated. Melt spinning commonly is conducted by applying high pressure to the fiber forming material, which has been heated to near the melting point of the material, thus forcing an extrudate through an opening of predetermined shape.

In the process of the invention, the composition that is to be spun into the conductive fibers contains the magnetic conductive filler material and at least one fiber forming material. The spinning composition may be obtained as a pre-mixed composition, or alternatively, the fiber forming material and conductive magnetic material may be mixed prior to spinning in accordance with any known mixing process.

The fiber forming material may comprise any polymer capable of being melt-spun, dry-spun or wet-spun. In particular, the fiber forming material is preferably a thermoplastic, thermosetting and/or solvent-soluble polymer capable of being spun by any of the above methods.

As examples, the fiber forming material may be one or more thermoplastic or thermosetting polymers such as polyamides, polyesters, or acrylic polymers. Suitable polyamides include nylon-6, nylon-11, nylon-12, nylon-66, nylon-611, nylon-612, etc. Suitable polyesters include, for example, polyethylene terephthalate, polybutylene terephthalate, etc. Suitable vinyl polymers include, for example, polyvinyl chloride, polyvinylidene chloride, etc. Further polymer materials that may be used as the fiber forming material include polyolefins, for example, polyethylene, polypropylene, polybutylene, etc., polyethers such as, for example, polyethylene oxide, polybutylene oxide, etc., polystyrene and polycarbonates. The fiber forming material may also comprise a mixture or copolymer of any of the foregoing materials.

Suitable solvent-soluble polymers that may be used as the fiber forming material include, for example, acrylic polymers such as, for example, acrylonitrile, cellulose polymers such as, for example, cellulose or cellulose acetate, vinyl alcohol polymers such as, for example, polyvinyl alcohol, polyurethanes, etc. Copolymers or mixtures of these materials may also be used.

If the fiber is to be formed by wet or dry spinning, a spinning solution must be formed by dissolving the fiber forming material in a suitable solvent. Any suitable solvent may be chosen as are well known in the art. Of course, the fiber forming material must be soluble in the solvent. Suitable solvents include, for example, N,N-diethylacetamide, chloroacetonitrile and water, bis(2-cyanoethyl)ether, and nitromethane and water for polyacrylonitrile fiber forming materials and the like, cyclohexanone, toluene, xylene, and methylene chloride for polyvinyl chloride fiber forming materials and the like, methanol, toluene, and ethanol and water for polyvinyl acetate fiber forming materials and the like, and m-cresol, o-chlorophenyl, dichloroacetic acid, and nitrobenzene for polyethylene terephthalate fiber forming materials and the like. Conventional solvents such as N,N-dimethylformamide or N,N-dimethylacetamide may also be used with various fiber forming materials.

In wet spinning, the spinning solution is spun through an orifice or spinneret and coagulated in an appropriate coagulation bath. Such baths are conventional and well known in the art. The fiber is then wound up. In dry spinning, the spinning solution is spun in the same manner as in wet spinning, but the coagulation bath is replaced with a gas atmosphere in which the solvent is evaporated. If necessary, the gas atmosphere may be heated to assist in removal of the solvent. The spun fiber is wound up in the same manner as in wet spinning.

The conductive magnetic material is contained in the spinning composition in an amount such that the conductive region of the end fiber contains a sufficient local concentration of conductive magnetic filler to yield the desired conductivity. For example, the conductive magnetic material may be present in an amount between about 8 and about 60% by weight, preferably between 8 and 25% by weight, and more preferably between 8 and 10% by weight of conductive magnetic material based on the weight of the region of the fiber containing the filler.

The local concentration of magnetically responsive conductive filler material may clearly be increased by the action of the magnetic field. FIGS. 1C and 1D and FIGS. 2C and 2D contrast the different cross sections that result with and without the presence of magnetic fields. FIGS. 1D and 2D clearly illustrate the uniformly dispersed filler material at a level below that which is necessary for electrical conduction (i.e., below the "perculation threshold"), for example, less than 8% by weight. FIGS. 1C and 2C illustrate the result of the magnetic fields acting upon the conductive magnetic filler material 110, thereby concentrating the filler into desired regions at the surface of the fiber wherein the local concentration is sufficiently high for conduction to occur (i.e., above the "percolation threshold"), for example, greater than 8% by weight. This condition applies whether or not the fiber is subsequently drawn to a smaller fiber diameter.

As the conductive magnetic material, particles of any shape, including blends of different shapes, are preferred. For the production of fine diameter conductive fibers, the conductive particles preferably have a diameter of less than 20 microns, preferably less than 5 microns, and more preferably less than 1 micron.

By "conductive magnetic material" is meant any material, or mixtures or combinations of materials, that is magnetically responsive and conductive. Materials which are electrically conductive and magnetic, such as iron, cobalt, nickel, various metal oxides, ferrites and magnetic carbon black, may be used directly. Semiconducting magnetic materials, such as some of the metal oxides of iron, and some ferrites, for example, may also be used directly, depending on the required conductivity. Insulating magnetic materials may also be used by mixing them with conducting materials to form composites or other intimate mixtures, such as, for example, materials with a core shell structure wherein the core consists of a magnetic material and the shell consists of an electrical conductor. Various embodiments are possible, and may be chosen according to the required electrical conductivity and magnetism.

In general, all conductive magnetic materials that show magnetization at the desired working temperature may be used. The magnetic strength of these materials, as measured by their magnetic saturation magnetization, in units of electromagnetic units per gram (emu/g), may vary from just above zero, that is, a few emu/g, up to, for example, iron, which has a saturation magnetization at room temperature of 210 emu/g. Thus, this range may include materials that are paramagnetic, which include salts of transition elements and salts and oxides of the rare earths, ferromagnetic, which include iron, cobalt, nickel and metal alloys, antiferromagnetic, which include some transition metal oxides, chlorides, fluorides, sulfides, chromium, alpha manganese and metal alloys, ferrimagnetic, which include cubic and hexagonal ferrites, maghemite, garnet and alloys, superparamagnetic, which include single domain nanoscale materials and clusters of paramagnetic ions, and materials that display other kinds of magnetism, such as metamagnetism, canted ferromagnetism, and any not already mentioned. Candidate materials may also include so called molecular magnets. In addition, the magnetic materials used may be magnetically hard or soft. The former possess large coercivity making it difficult to demagnetize the materials while the latter possess very low coercivity making it easy to demagnetize the material. Barium and strontium ferrites are examples of the former while elemental iron is an example of the latter.

Preferred conductive magnetic materials include, for example, iron containing carbon black, metal particles such as, for example, nickel, iron, cobalt, etc., oxides thereof, and mixtures thereof, as well as powders of the magnetic alloys such as permaloy, molybdenum permaloy and the like. Most preferably, the conductive particles comprise fine diameter (i.e., less than 1 micron) iron containing carbon black or iron powder.

The fiber forming composition may also include various well-known additives, including, for example, lubricants such as waxes, polyethylenes, silicone compounds such as oils and polyorganosiloxanes, and fluorine compounds such as oils and fluorocarbons, in amounts of from about 0.01 to 5% by weight of the fiber forming composition; antistatic agents such as polyalkylene oxides, for example, ethylene glycol or other well known surfactants, in an amount of 0.1 to 10% by weight of the fiber forming composition; and other well known additives including delusterants, pigments, dyes, stabilizers, flame retardants, and the like.

Following spinning, the fiber is formed but is not yet in a final, solidified form. In other words, the fiber forming material is still in a lower viscosity state due to the heat and pressure of melt spinning or solvent dilution of residual solvent following wet or dry spinning. Thus, it is necessary to cure and/or solidify the fiber in a known manner, for example by cooling or drying by heat treating and then cooling. Any heat treatment must remain below the decomposition point of the fiber forming and filler materials. Drying at an elevated temperature on the order of 50°–200° C. for a period of time sufficient to dry the fiber is sufficient. Of course, the temperature and time for solidifying the fiber will vary depending upon the spinning method used to form the fiber, the fiber forming material and the amount of conductive magnetic material contained in the fiber. Appropriate times and temperatures may readily be determined by one of skill in the art.

Following formation of the fiber shape, but prior to solidifying the fiber, a magnetic field is applied to the fiber in order to cause the magnetically responsive conductive materials in the fiber composition to migrate toward the outer periphery of the fiber. The magnetic field may be applied at any point following formation of the fiber shape and before final solidification and/or curing of the fiber. In other words, the fiber may be subjected to a magnetic field immediately upon exit from the orifice or spinneret, upon entry to the coagulation bath or gas atmosphere in wet or dry spinning, or just prior to the formed fiber being solidified. Regardless of when the magnetic field is applied to the fiber, the fiber must be present in the magnetic field for a time sufficient for the magnetic field to force the conductive magnetic material toward the outer periphery. Preferably, the majority of the conductive magnetic material, i.e., greater than 90% of the conductive magnetic material, is drawn to the outermost 25% of the cross-sectional diameter of the fiber, and more preferably to the outer 1–10% of the cross-sectional diameter of the fiber. As should be understood by one of ordinary skill in the art, the amount of time that the fiber is to be in contact with the magnetic field depends upon the strength of the magnetic field, the viscosity of the fiber forming material at the time the field is applied, and upon the extent to which it is desired to migrate the conductive magnetic materials to the outer periphery of the fiber. Resident times on the order of, for example, 0.1 to 5 seconds are generally sufficient when using magnetic fields having strengths on the order of, for example, 1,000 to 100,000 gauss where the viscosity of the film material is on the order of 100 to 50,000 centipoise, for example.

Reference is now made to the drawing figures, which illustrate but three examples of magnetic arrangements that might be used in the present process and the resulting fiber cross-sections achieved following application of the magnet to the fiber.

Figure 1B:
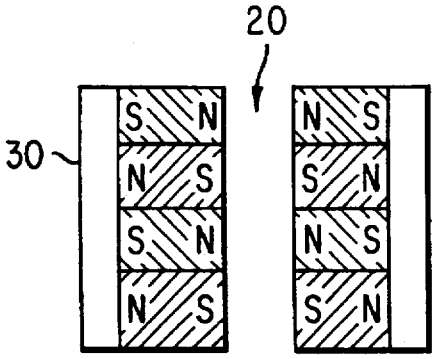
Figure 1C:
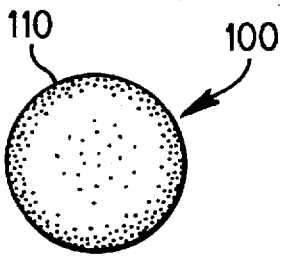
FIG. 1C is a cross-sectional view of a fiber obtained in the process of the invention using the magnet of FIGS. 1A–1B.
Figure 1D:
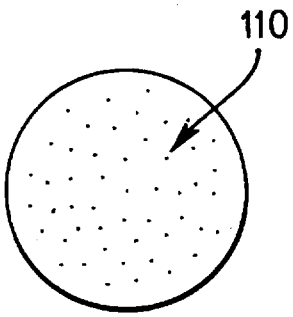
FIG. 1D is a cross-sectional view of a fiber obtained in conventional processing without use of a magnet of FIGS. 1A–1B.

FIG. 1A is a top view of a magnet 10 through which the formed fiber passes via passage 20. As seen in FIG. 1B, a cross-section of magnet 10 of FIG. 1A, magnet 10 comprises radially poled magnets. The radially poled magnets are surrounded by a keeper 30, for example a soft iron keeper. As the fiber 100 passes through the magnet 10 via passage 20, the conductive magnetically responsive particles 110 are uniformly drawn toward the outer periphery of the fiber as shown in the cross-section of FIG. 1C.

Figure 1E:
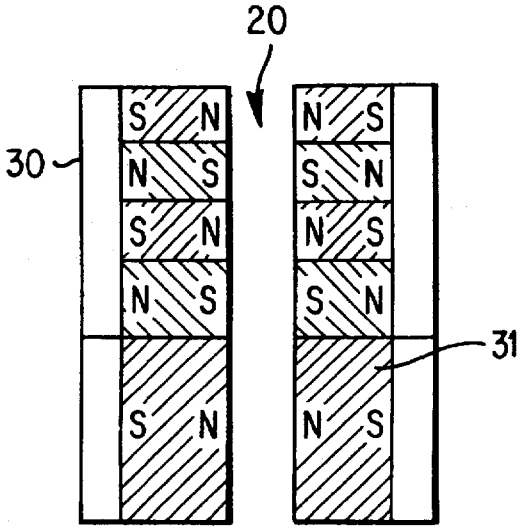
FIG. 1E is a modified magnet of FIG. 1B.

The fabrication method illustrated in FIG. 1B may be altered as shown in FIG. 1E so as to provide a particle loosening effect to cause easier migration of the conductive magnetic materials toward the surface of the fiber. Thus, as the conductive magnetic material is passed through the alternating north and south poles of the magnets, the particles experience a back and forth or torquing motion so as to give them better migration in the fiber forming matrix. The large pole face magnet 31 at the end of the sequence of magnets serves to cause the final migration of the conductive magnetic particles to the surface. Processing time and temperature, viscosity, loading and filler material constitute important parameters in the processing and may be adjusted in order to obtain a desired result.

Figure 2A:
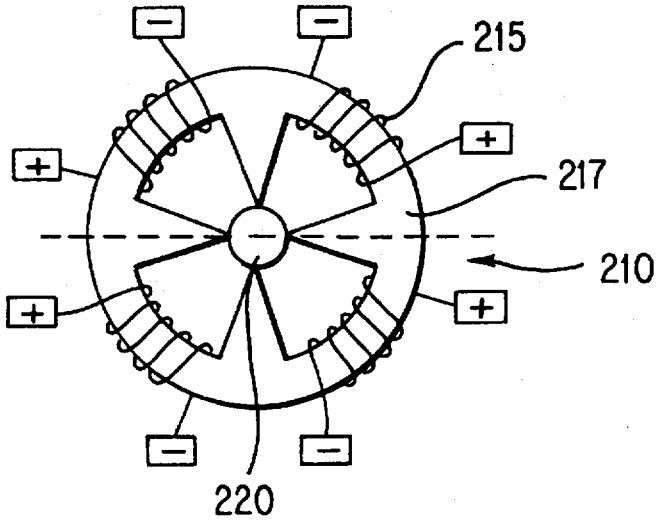
FIGS. 2A–2B represent different views of another magnet usable in the present invention.
Figure 2B:
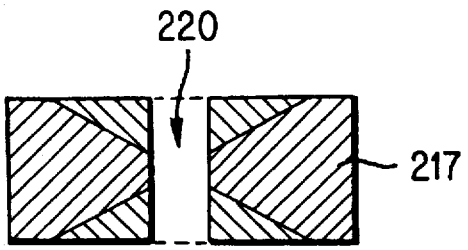
Figure 2C:
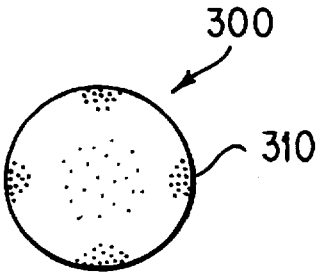
FIG. 2C is a cross-section of a fiber that might be obtained using the magnet of FIGS. 2A–2B.
Figure 2D:
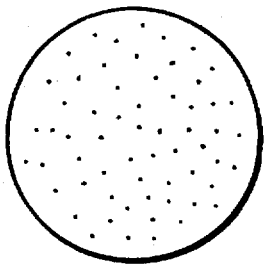
FIG. 2D is a cross-sectional view of a fiber obtained in conventional processing without use of a magnet of FIGS. 2A–2B.

FIGS. 2A–2B illustrate an alternative embodiment of a magnet. As illustrated in FIG. 2A, magnet 210 is an electromagnet in which electric current is passed through wire coils 215 wrapped around a soft iron core 217 in order to produce the magnetic field. The fiber passes through the magnetic field via passage 220, as seen in the cross-section of the magnet in FIG. 2B. As seen in FIG. 1C, a fiber passed through the magnet 210 having the arrangement shown in FIGS. 2A and 2B permits the formation of a fiber 300 having stripes of conductive magnetic particles 310 along the outer periphery. Additional or fewer stripes may be obtained by adding or removing additional coil sections to or from the magnet 210. As understood by one of ordinary skill in the art, the magnetic field strength produced by the magnet having the arrangement shown in FIGS. 2A and 2B depends on the number of turns of the coiled wire 215, the size of the current passing through the coils, and the magnetic permeability of the core 217.

Figure 3A:
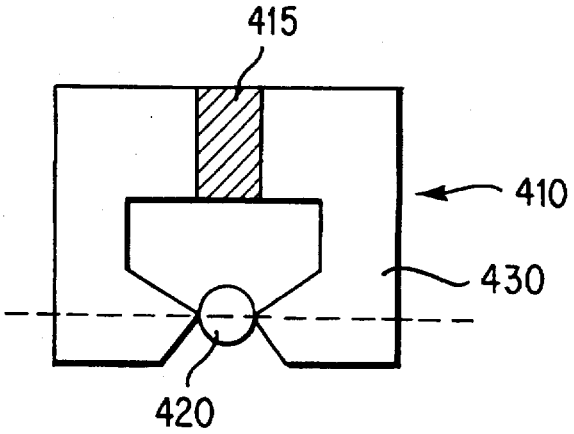
FIGS. 3A–3B represent another magnet also usable in the present invention.
Figure 3B:
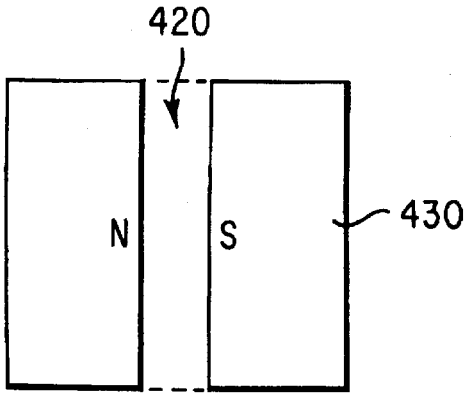
Figure 3C:
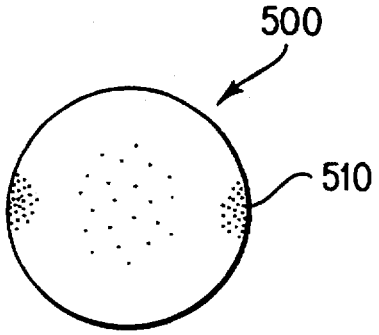
FIG. 3C is a cross-section of a fiber that might be obtained using the magnet of FIGS. 3A–3B.

FIGS. 3A and 3B illustrate another possible arrangement for a magnet to be used in the process of the invention. In FIG. 3A, the magnet 410 comprises a permanent magnet or coil 415 and soft iron pole faces 410. The fiber passes through the magnetic field created by the magnet 410 via passage 420, as best seen in FIG. 3B. As seen in the fiber cross-section of FIG. 3C, a fiber subjected to the magnetic arrangement of FIGS. 3A and 3B has the conductive magnetic particles 510 concentrated in two strips of the outer periphery of the fiber 500.

Thus, as can be seen from the figures, by selection of the magnet arrangement, it is possible to obtain fibers in which the conductive magnetic materials are arranged in a uniform pattern in the outer periphery of the fiber or a non-uniform pattern in the outer periphery of the fiber. For example, using a circular or toroid magnet around the fiber parameter serves to draw the conductive magnetic materials uniformly to the periphery of the fiber. Non-uniform patterns of the conductive magnetic materials along the periphery of the fiber, for example, stripes or patches, can be obtained by using a narrow magnetic field juxtaposition to the fiber. In addition, by rotating the magnet and/or the fiber while it is in the magnetic field, it is possible at high rotation rates to obtain a uniform pattern of the conductive magnetic materials at the periphery of the fiber using any type of magnet or, at lower rotation rates, to obtain rotating strips of magnetic materials in the outer periphery of the fiber. By controlling the magnetic fields and the solidification rates of the fiber, control of the conductive magnetic material gradient as a function of the radius of the fiber can be achieved to enable a wide variety of unique fiber configurations.

The strength of the magnetic field applied to the fiber is preferably on the order of, for example, 1,000 to 100,000 gauss, more preferably 25,000 to 100,000 gauss, although any strength of magnetic field may be used so long as other factors, such as the fiber exposure time to the magnetic field, viscosity, the degree of solidification of the fiber when contacting the magnetic field, and the conductive magnetic material loading amount are appropriately adjusted to permit the magnetic field to sufficiently draw the conductive magnetic material toward the outer periphery of the fiber.

Following exposure of the fiber to the magnetic field, the fiber is then solidified and/or drawn to obtain the final electrically conductive fiber. The fiber may be solidified as discussed above. For example, solidification of thermosetting polymers may occur by heat or induction curing, solidification of solvent-soluble polymers may occur by heat drying, and solidification of thermoplastic polymers may occur by cooling.

The fibers are preferably drawn during take-up as well known in the art. Drawing thus may occur during final solidification (e.g., hot drawing), although it is also possible to draw fibers after solidification (e.g., cold drawing) as well known in the art. Typical drawing ratios for the fiber may range from, for example, 1.1 to 10, and are typically on the order of 1.1 to 2 or 2 to 10. The invention enables high draw ratios, for example from 5 to 10. Of course, the final draw ratio depends upon what starting and final fiber diameters are required.

It is necessary to apply the magnetic field to the fiber prior to drawing. Otherwise, the conductive magnetic materials are uniformly contained in the cross-section of the fiber and act as flaw initiating sites within the centermost region of the fiber and therefore may reduce the tensile strength of the fiber and cause fiber breakage during drawing. An advantage of the present invention is that during drawing, fiber breakage does not occur even with very fine diameter fibers containing the conductive magnetic materials. This is because the conductive magnetic materials are located at the periphery of the fiber following application of the magnetic field, thereby reducing the number of flaw initiating sites in the core of the fiber. Accordingly, the fiber maintains a sufficiently high tensile strength to avoid breakage of the fiber during drawing and during use.

The fibers produced by the method of the invention are usable in any embodiments where conductive fibers or magnetic fibers are desired. The fibers may be used in any knitted, woven or non-woven textile type arrangement. In such textiles, the conductive fibers may be combined with other conventional non-conductive fibers, including natural and synthetic fibers.

Fibers produced in the method of the invention may have wide ranges of fineness and diameter. The fineness of the fiber may range from, for example, 1 to 1000 denier. The fiber may have a diameter ranging from, for example, 10 to 2000 microns.

In a preferred embodiment, fine diameter conductive fibers produced by the above-described process are used in an electrostatic cleaning device that contacts an imaging member surface in order to remove any residual toner remaining on the imaging member surface following transfer of a developed image from the imaging member surface. The electrostatic cleaning device incorporating the conductive fibers according to the present invention is preferably provided in the form of a rotary brush, a drum or a belt.

A plurality of the conductive fibers are in attached association with the cleaning device. In a preferred embodiment, the plurality of conductive fibers are formed into a pile fabric, for example by knitting or weaving. The piles of the fabric customarily have a pile height of between 1 and 50 mm, more preferably on the order of 3 to 15 mm. Fiber fill density in a plush pile fabric of 1,000 to 1,000,000 fibers/in$^2$ are preferred, with 30,000 to 350,000 fibers/in$^2$ most preferred.

As discussed above, the conductive fibers of the cleaning device may be combined with additional nonconductive fibers in forming the fibers of the electrostatic cleaning device. The conductive fibers preferably comprise, for example, 50 to 100% by weight of the fibers in the cleaning device, more preferably 75 to 100% by weight of the total fibers.

For use in electrostatic cleaning devices, for example as described in U.S. Pat. No. 4,835,807 to Swift, incorporated herein by reference, the conductive fibers preferably have a very fine diameter, for example, from about 10 to about 50 microns, more preferably from about 20 to about 40 microns, and a fineness on the order of, for example, 0.1 to 300 deniers, more preferably on the order of 1 to 20 deniers. The resistance of the individual conductive fibers incorporated into the cleaning device is preferably within the range of 0.1 to $10^{17}$ Ω/cm, more preferably $10^2$ to $10^{13}$ Ω/cm, and most preferably $10^3$ to $10^{10}$ Ω/cm.

Recognizing of course that the fiber resistance results from the concentration of conductive magnetic filler material at the surface region of the fiber, the fiber resistance per unit length is an appropriate and accurate measure of an important electrical characteristic. An "effective" resistivity can be calculated assuming an equal filler concentration distribution to correspond to the above defined ranges. Thus, effective resistivities of the individual fibers for use in an electrostatic cleaning device within the range of $10^{-4}$ to $10^{13}$ Ω-cm are preferred, more preferred are resistivities within the range of $10^{-2}$ to $10^9$ Ω-cm, and particularly preferred are resistivities within the range 0.1 to $10^6$ Ω-cm. Clearly, metallic resistivities, for example less than $10^{-4}$ Ω-cm are avoided because of problems with undesirable electrical shorting of the entire brush mass upon incidental contact with nearby ground potential on, for example, machine frames, grounded chassis, grounded shafts, etc.

Electrostatic cleaning devices formed from conductive fibers produced in accordance with the method of the invention yield cleaning devices superior in removing residual toner from the imaging member surface over long periods of time. Further, the fibers have excellent fineness so as to not damage in any manner the surface of the imaging member. Thus, electrostatographic printing devices utilizing the electrostatic cleaning device generate clear images without stains or fog over long periods of operation.

The invention is now further described by way of the following examples.

EXAMPLE 1

A mixture of 1 gram of iron containing electrically conductive carbon black and 100 grams of low molecular weight polyethylene wax is prepared by melt blending in a laboratory beaker with manual agitation to produce an essentially uniform mixture. Upon cooling to room temperature, the blended composite solidifies into a disc approximately 2.5 inches in diameter and approximately ¼ inches thick. The disc is observed to be uniformly black in appearance when viewed from all angles. A cross cut is made in the composite which is also observed to be uniformly black in appearance. The filler to polymer concentration is calculated at 1% by weight and the electrical resistance is measured at several random locations along the top, bottom and sides of the solidified disc. All resistance measurements are above 200 megaohms, which is the upper limit of the multimeter used.

The composition is then remelted and resoldified in the same beaker during which time a permanent magnet is affixed to the underside of the beaker. Once cooled to room temperature, the disc is examined visually and is observed to exhibit a clearly visible thin layer of black filler concentrated along the bottom surface where the magnet is positioned, and a translucent white, thick upper layer resembling the natant polymer. Electrical resistance is measured at numerous random areas along the bottom and top surfaces and reveals resistances of between approximately 10 ohms and 2500 ohms everywhere along the bottom surface and above 20 megaohms everywhere else. This illustrates the magnetically affected migration and surface concentration of magnetically responsive electrically conductive filler material in a fiber forming material which as a composite is initially nonconductive. Upon processing via the current invention, the concentration of the filler material at the surface produces the desired enhancement of electrical conductivity.

EXAMPLE 2

A uniformly dispersed mixture of 100 grams of magnetic conductive carbon black and 1600 grams of nylon 6 to yield an initial concentration of about 6% by weight is formed. The filler level is chosen below the electrical perculation threshold so that the composite will have a d.c. volume resistivity, greater than about $10^{14}$ to $10^{15}$ Ω-cm, which is equal to or nearly the same as the unfilled nylon 6 fiber forming polymer. The tensile strength of the composite is approximately equal to that of the polymer and is largely unaffected by the low level of filler present in the blend. The composite is melt extruded via a vented extruder having an appropriately sized fiber spinerette orifice to which a neodymium iron boron permanent magnet of about one Tesla in strength (similar to FIGS. 1A and 1B) is coaxially mounted. The magnet is configured to extend along the entire fiber forming length, particularly where the fiber resides downstream of the spinerette where the fiber is still in the molten, low viscosity state. The forces exerted on the conductive magnetic filler material are sufficient to effect movement of the filler outwards of the molten fiber and concentrate the filler along the perimeter of the fiber, thereby rendering the resistance of the fiber less than about $10^5$ Ω/cm.

While this invention has been described in conjunction with specific embodiments thereof, it is evident that many alternatives, modifications and variations will be apparent to those skilled in the art. Accordingly, the preferred embodiments of the invention as set forth are intended only as illustrative guides. Various changes may be made without departing from the spirit and scope of the invention as defined above.

What is claimed is:

1. A method of making a conductive fiber, comprising forming a fiber shape from a mixture comprising at least one fiber forming material and conductive magnetic materials, applying a magnetic field to the fiber shape such that the conductive magnetic materials migrate toward a periphery of the fiber shape, and after applying the magnetic field, solidifying the fiber shape to obtain the conductive fiber.

2. The method according to claim 1, wherein the fiber shape is formed by melt spinning.

3. The method according to claim 2, wherein the magnetic field is applied to the fiber shape at a point after forming wherein the fiber shape has a low viscosity sufficient to permit the migration of the conductive magnetic materials toward the periphery of the fiber.

4. The method according to claim 1, wherein the fiber shape is formed by wet spinning or dry spinning.

5. The method according to claim 4, wherein the magnetic field is applied to the fiber shape at a point after forming wherein the fiber shape retains sufficient solvent to permit the migration of the conductive magnetic materials toward the periphery of the fiber.

6. The method according to claim 1, wherein the method further comprises forming a mixture of the at least one fiber forming material and the conductive magnetic materials prior to forming the fiber shape.

7. The method according to claim 1, wherein the method further comprises drawing the fiber shape or the conductive fiber following application of the magnetic field.

8. The method according to claim 1, wherein the fiber forming material comprises a thermoplastic, thermosetting or solvent soluble polymer.

9. The method according to claim 1, wherein the fiber forming material is selected from the group consisting of polyamides, polyesters, polyolefins, polyethers, acrylic polymers, copolymers of the foregoing, and mixtures of the foregoing.

10. The method according to claim 1, wherein the conductive magnetic materials comprise particles of at least one of magnetic carbon black, metal, or metal oxide.

11. The method according to claim 1, wherein the magnetic field is applied to locate the conductive magnetic materials uniformly on the periphery of the fiber.

12. The method according to claim 1, wherein the magnetic field is applied to locate the conductive magnetic materials in a non-uniform pattern on the periphery of the fiber.

13. The method according to claim 1, wherein the conductive magnetic materials are substantially located in the outer 10% of a cross-sectional diameter of the fiber.

* * * * *